United States Patent [19]

Jaksich

[11] 4,164,784

[45] Aug. 14, 1979

[54] ADJUSTABLE ILLUMINATING DEVICE

[75] Inventor: Milenko Jaksich, Burbank, Calif.

[73] Assignee: Sight Lite, Inc., Los Angeles, Calif.

[21] Appl. No.: 820,447

[22] Filed: Aug. 1, 1977

[51] Int. Cl.[2] ..... F21V 21/26; F21P 5/00; F21M 3/18

[52] U.S. Cl. ..... 362/282; 362/371; 362/427

[58] Field of Search ..... 362/269, 270, 285, 287, 362/371, 427, 370, 282, 284, 232, 220

[56] References Cited

U.S. PATENT DOCUMENTS

| | | | |
|---|---|---|---|
| 3,108,751 | 10/1963 | Rodmaker | 362/427 |
| 3,505,515 | 4/1970 | Adra | 362/371 |
| 3,543,016 | 11/1970 | Jones | 362/371 |
| 3,604,923 | 9/1971 | Moffatt | 362/427 |
| 3,610,915 | 10/1971 | Moore | 362/282 |
| 3,749,907 | 7/1973 | Allmand | 362/371 |
| 3,860,903 | 1/1975 | Steenhoven | 362/232 |

*Primary Examiner*—Verlin R. Pendegrass
*Assistant Examiner*—Donald P. Walsh
*Attorney, Agent, or Firm*—Huebner & Worrel

[57] ABSTRACT

An adjustable flood light enclosed in a waterproof casing is mounted for unlimited rotation between spaced support legs fixed to a base. The light source within the enclosure is carried by a support leg through which its wiring passes and it does not rotate with the enclosure. The enclosure may be clamped to one or both support legs to secure it in any desired angular adjustment.

7 Claims, 5 Drawing Figures

ADJUSTABLE ILLUMINATING DEVICE

BACKGROUND OF THE INVENTION

1. Field of the Invention

The present invention relates to improvements in illuminating devices and more particularly to improvements in adjustable flood lighting equipment suitable for either interior or exterior applications.

2. Description of the Prior Art

The increasing use of both interior and exterior flood lighting for decorative and/or security purposes has led to the design of a wide variety of flood lighting fixtures for various mounting applications, but a need has been found to exist for a single such fixture adaptable to a wide variety of applications.

Such a fixture should be adapted for pad, ceiling or wall mounting; should be weather-tight, with a minimum of hardware or electrical wiring exposed; and should have a light pattern rotationally adjustable in the field to any angle without disturbance to the light source or its wiring. So far as is known, no available fixture meets these requirements, and it is the primary object of the invention to provide a fixture of economical and efficient design which does so.

SUMMARY OF THE INVENTION

The illuminating device of the present invention comprises a lamp enclosure adapted to receive either an incandescent or fluorescent light source and provided with a window opening. It is mounted for 360° rotation on an axis paralleling the plane of the window opening by means of a pair of spaced support legs to one or both of which the light source disposed within the enclosure is secured, so that it does not rotate with the enclosure. The wiring for supplying electrical current to the light source is enclosed within one or both of the support legs which in turn are carried on a base so spaced from the axis of the lamp enclosure as to avoid interference with its rotation. Means are provided for releasably clamping the lamp enclosure to at least one of the support legs so that it may be secured in any desired angular position.

DESCRIPTION OF THE PREFERRED EMBODIMENT

Figure 1:
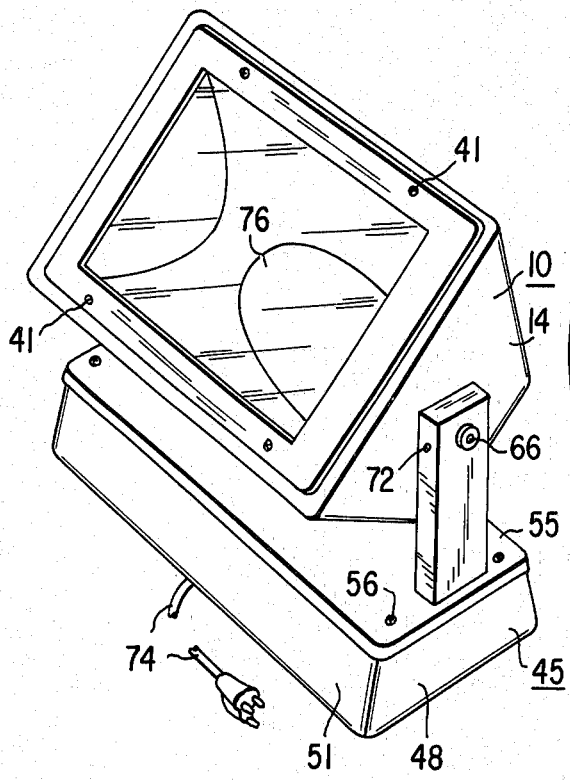
FIG. 1 is a perspective view of an illuminating device embodying the present invention.

As shown in the accompanying drawings, the preferred embodiment of the device of the present invention comprises a lamp housing 10 forming an enclosure having a bottom wall 11 (FIG. 4), side walls 12 and 13, and end walls 14 and 15 (see also FIG. 5) which are provided with axially aligned circular openings 17 and 18, respectively. A window opening 20 is defined by a flange 21 at the top of the lamp housing 10; the flange being provided with threaded holes 22 for a purpose to be described.

Figure 4:
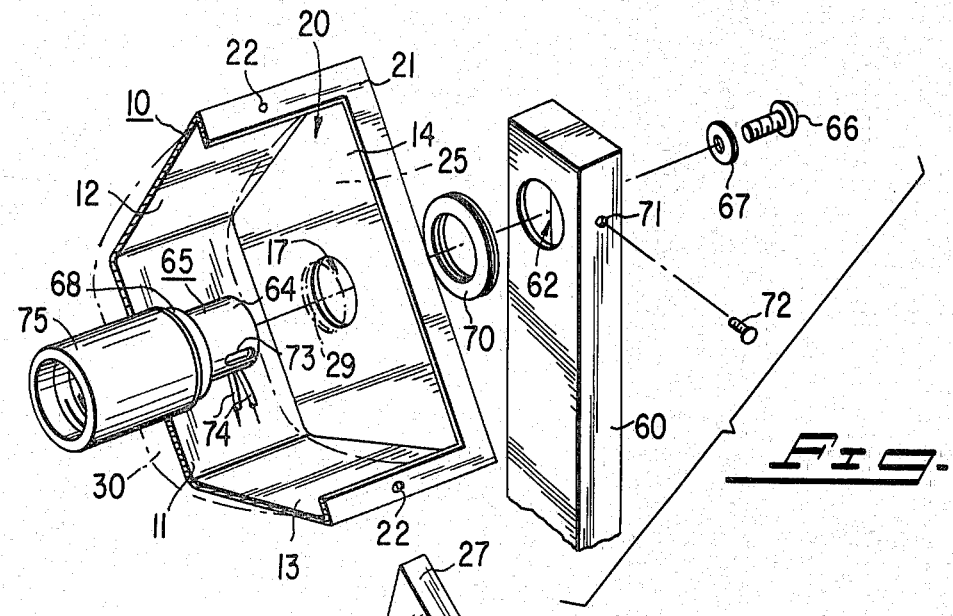
FIG. 4 is an exploded view in perspective showing details of the lamp mounting and one of the pivotal mountings of the lamp enclosure.
Figure 5:
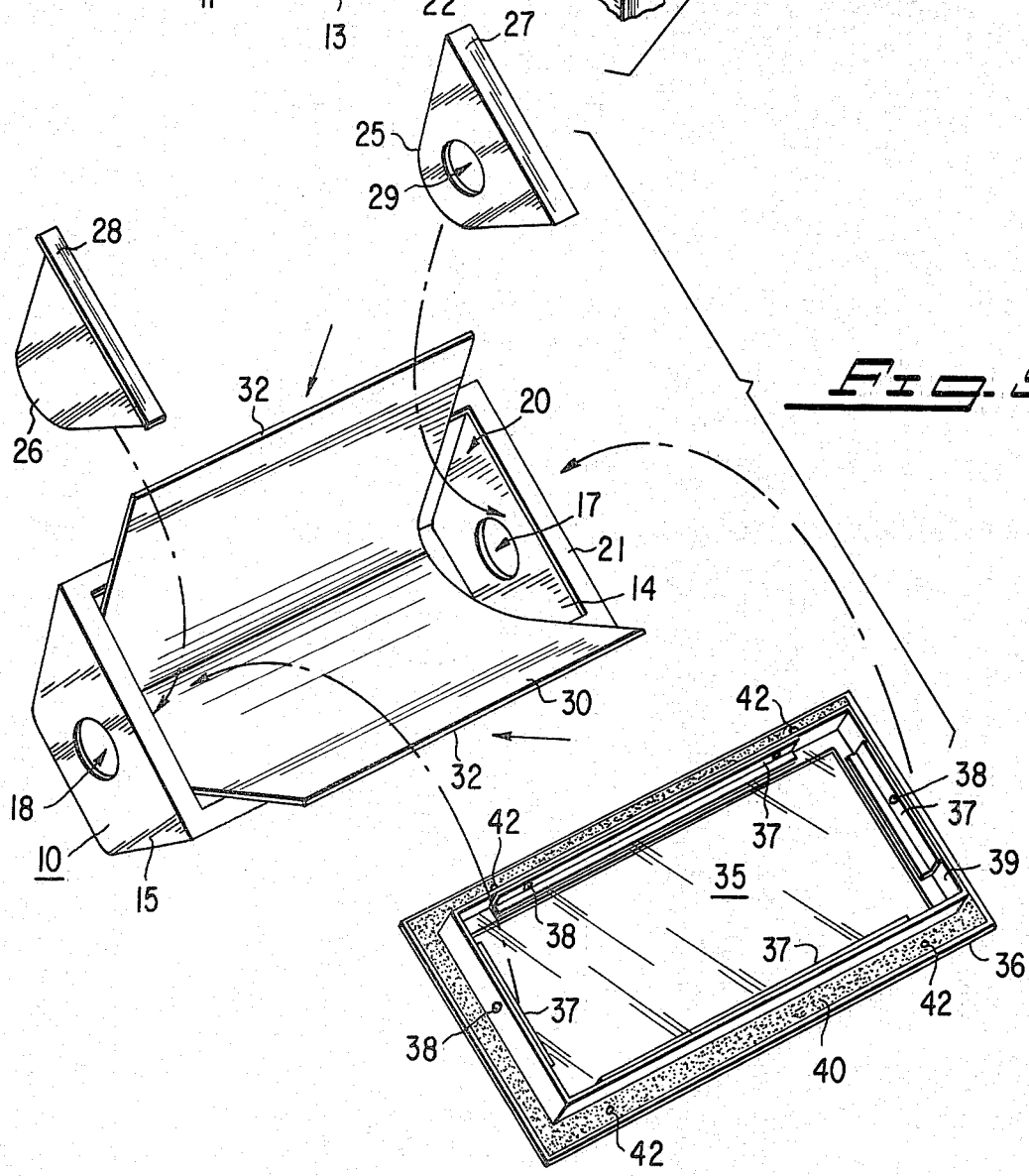
FIG. 5 is an exploded view in perspective of details of the lamp enclosure.

End plates 25 and 26 (FIG. 5) are provided with flanges 27 and 28, respectively, designed to fit under the portions of the flange 21 of the lamp housing which are adjacent end plates 14 and 15, respectively; and the end plate 25 is provided with a circular opening 29 which, when the end plate 25 is positioned as shown in ghosted lines in FIG. 4, is axially aligned with the circular opening 17 in the end plate 14. The end plates 25 and 26 are held in position adjacent the end walls 14 and 15, respectively, by a resilient, flexible sheet 30 of reflective material, the edges 32 of which fit under and are retained by the portions of the flange 21 formed on the upper and lower side walls 12 and 13, respectively, as shown in ghosted lines in FIG. 4.

Figure 2:
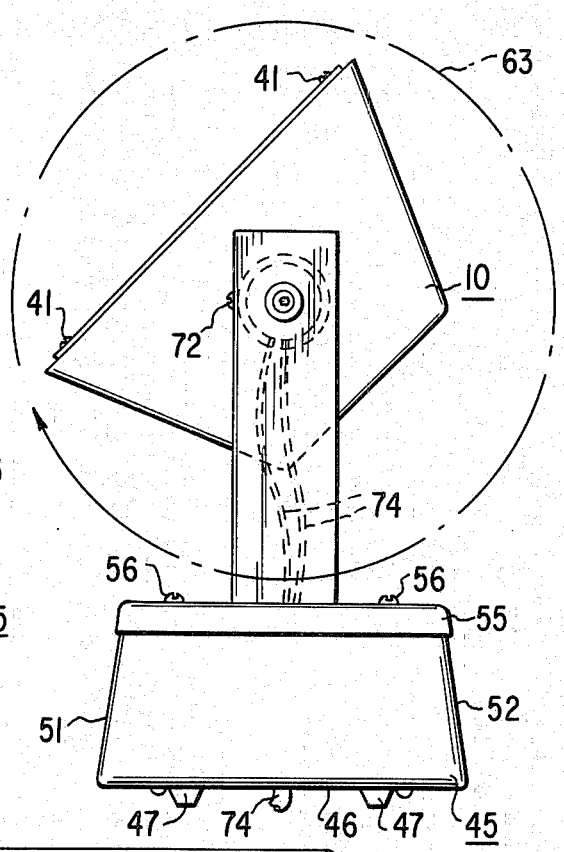
FIG. 2 is a view in end elevation of the device of FIG. 1.
Figure 3:
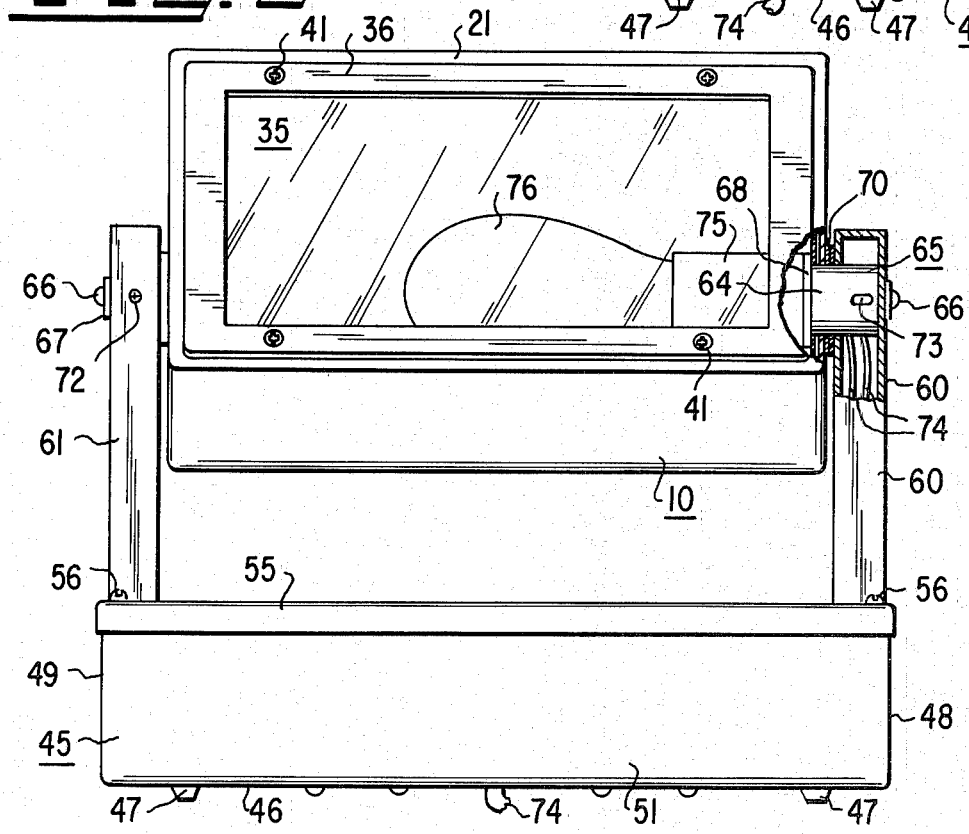
FIG. 3 is a view in front elevation of the device of FIG. 1.

A weather-tight closure for the window opening 20 of the lamp housing is provided by a sheet 35 of transparent material which is retained against the under side of the inner edge of a frame 36, which is T-shaped in cross-section, by angle brackets 37 secured by means such as screws 38 to the angular portion 39 of the frame 36. A gasket 40 of compressible material, such as rubber or the like, secured to the frame 36 adjacent its outer edges, forms a seal between the frame 36 and the flange 21 when the frame 36 is secured in position as shown in FIGS. 1, 2 and 3 by means such as screws 41 which pass through holes 42 (FIG. 5) in the frame 36 and gasket 40 and engage the threaded holes 22 (FIG. 4) in the flange 21.

The lamp housing 10 is supported on a base 45 (FIGS. 1, 2 and 3) having a bottom 46 preferably provided with cushioning feet 47, side walls 48 and 49, a front wall 51, and a back wall 52. The base 45 is adapted to contain auxiliary electrical equipment such as a transformer, ballast, starter, etc. in the event a fluorescent light source is employed, and includes a preferably gasketed base cover 55 removably secured in place by means such as screws 56.

Means are provided for mounting the lamp housing 10 for rotation through 360° on an axis paralleling the plane of the window opening 20. This means comprises a pair of hollow support legs 60 and 61 provided on their facing sides with circular openings 62 (FIG. 4) designed to be aligned with the circular openings 17 and 18 of the lamp housing 10 and spaced sufficiently from the base cover 55 to permit 360° rotation of the lamp housing 10 on the axis of said openings as indicated by the dot-dash line circle 63 in FIG. 2. The shanks 64 of cylindrical flanged bearing posts 65 are received in the aligned circular openings 17, 29, 62 and 18, 62 and secured to their respective support legs 60 and 61 by screws 66 carrying washers 67.

Means are provided for releasably securing the lamp housing 10 to one or both of the support legs 60, 61 to restrain the housing against rotation on the bearing posts 65 and thus secure the lamp housing in any rotational position to which it has been adjusted. Bearing posts 65 have flanges 68 which are larger in diameter than the openings 17, 29 and 18, respectively, and compressible friction washers 70 of fibrous material are interposed between the side walls 14, 15 of the lamp housing 10 and the support legs 60, 61, respectively. This arrangement is such that when the screws 66 are loosened, the lamp housing 10 may be rotated on the axis of the bearing posts 65 to any desired position. When the screws 66 are tightened, however, the resultant axial movement of the bearing posts 65 clamps the side walls 14, 15 of the housing 10 and the washers 70 between the larger portions 68 of the bearing posts 65 and the support legs 60, 61, respectively, to secure the lamp housing in the position to which it has been adjusted; the washers 70 then forming a weather-tight seal for the openings 17 and 18.

Means are provided for restraining the bearing posts 65 against rotation with respect to the support legs 60, 61. Threaded into a hole 71 in each of the support legs 60, 61 is a screw 72 which engages an elongated slot 73 in its respective bearing post 65 so as to prevent rotation of the bearing post with respect to the support leg while permitting limited axial movement for the purpose of securing the lamp housing to or releasing it from the support leg as described above.

In the illustrated embodiment, there is secured to the inner end of the bearing post 65, which is carried by the support leg 60, a socket 75 adapted to receive an incandescent light bulb 76 (FIGS. 1 and 3); the socket being electrically connected to an electric current source via wiring 74 which is passed through the bearing post 65, out of a side aperture therein (not shown) and through the interior of support leg 60 into base 45; exiting from the bottom thereof. It is understood, however, that should it be desired to employ a fluorescent light source, appropriate fittings would be carried by both of the bearing posts 65, connected electrically to transformer, ballast and starter equipment in the base 45, as mentioned hereinabove.

In operation, the device of the present invention may be rested upon a pad or alternatively the bottom 46 of its base 45 may be secured by bolts or the like to a wall or ceiling and appropriate electrical connections thereto made by means of the wiring 74. The screws 66 are then loosened to permit rotation of the lamp housing 10 upon the bearing posts 65, it being noted that since the bearing posts are secured against rotation therewith by the screws 72 engaging the slots 73 in the bearing posts, the lamp housing 10 may be rotated through 360° repeatedly, if desired, without in any way disturbing the lamp socket 75 or the wiring 74 thereto; with the lamp 76 illuminated during such adjustment if desired. When the adjustment has been completed, the screws 66 are tightened, compressing the friction washers 70 between the side walls 14, 15 of the lamp housing 10 and the inner side walls of the support legs 60, 61, and securing the lamp housing 10 in the desired angular position to which it has been adjusted.

I claim:

1. In an illuminating device, a lamp housing including an enclosure having end walls provided with axially aligned openings therethrough and a window opening on one side thereof, means for mounting said housing for rotation on an axis paralleling the plane of said window opening, said means comprising a pair of spaced support legs, a pair of cylindrical bearing posts coaxially mounted on said legs opposite and extending toward each other; said posts engaging the aligned openings in said lamp housing, a lamp mounting carried by one of said bearing posts interiorly of said housing, and means for restraining said one of said bearing posts against rotation with respect to the support leg on which it is mounted while permitting rotation of said housing on said bearing posts.

2. An illuminating device according to claim 1 including, additionally, means for releasably securing said lamp housing to one of said support legs to restrain said housing against rotation on the bearing post mounted on said one of said support legs.

3. An illuminating device comprising a base, a pair of spaced support legs carried by said base; at least one of said legs being hollow to provide a conduit for electrical wiring, a pair of cylindrical bearing posts coaxially mounted opposite and extending toward each other on said legs; at least one of said posts being secured against rotation with respect to said one of said legs, a lamp housing rotatably mounted on said bearing posts; said housing being spaced from said base sufficiently to permit unlimited rotation thereof on said bearing posts, a lamp carried by said one of said posts interiorly of said housing, means connecting said lamp with a source of electrical energy comprising wiring extending therefrom through said one of said posts and said hollow support leg.

4. An illuminating device according to claim 3 including, additionally, means for releasably securing said lamp housing to one of said support legs to restrain said housing against rotation on the bearing post mounted on said one of said support legs.

5. In an illuminating device, a lamp housing having a window opening provided with a weather-tight seal and a circular mounting opening; means for mounting said housing for pivotal adjustment about the axis of said circular mounting opening including a support member having an opening and a flanged tubular member having its flange disposed interiorly of said housing and its shank extending through said mounting opening and into the opening in said support member; a compressible washer on the shank of said tubular member between said housing and said support member, means carried by said support member for moving said tubular member axially to clamp said washer between said housing and said support member, thereby simultaneously securing said housing in any desired pivotal adjustment with respect to said support member and effecting a weather-tight seal of said circular mounting opening.

6. An illuminating device comprising a base, a pair of spaced support legs carried by said base; at least one of said legs being hollow to provide a conduit for electrical wiring, a lamp housing having end walls and a window opening in one side thereof; at least one of said end walls having an opening therethrough, means carried by said legs for mounting said housing thereon for unlimited rotation on an axis paralleling the plane of said window opening; at least one of said means including a bearing post carried by and restrained against rotation with respect to one of said legs and extending through said side wall opening, a lamp mounting carried by said one bearing post interiorly of said housing, and wiring extending from said lamp mounting through said bearing post and into said one of said legs.

7. An illuminating device according to claim 6 in which said one bearing post is cylindrical and said lamp mounting is coaxial therewith.

* * * * *